United States Patent [19]

Kostecky

[11] 4,106,738

[45] Aug. 15, 1978

[54] BASE BRACKET FOR SHELVING

[75] Inventor: James F. Kostecky, Bethlehem, Pa.

[73] Assignee: Bethlehem Steel Corporation, Bethlehem, Pa.

[21] Appl. No.: 819,315

[22] Filed: Jul. 27, 1977

[51] Int. Cl.[2] ..... A47B 96/06

[52] U.S. Cl. ..... 248/235; 248/243; 211/192

[58] Field of Search ..... 248/235, 243, 188, 188.1, 248/188.8, 188.7; 108/108; 211/192, 193

[56] References Cited

U.S. PATENT DOCUMENTS

| | | | |
|---|---|---|---|
| 857,543 | 6/1907 | Thomas | 248/243 |
| 3,054,511 | 9/1962 | Erismann | 248/243 X |
| 3,570,798 | 3/1971 | Squibb | 248/243 |
| 3,601,432 | 8/1971 | Fenwick | 211/192 |
| 3,730,108 | 5/1973 | Stroh | 211/192 X |

*Primary Examiner*—Francis K. Zugel

*Attorney, Agent, or Firm*—Joseph J. O'Keefe; Michael J. Delaney

[57] ABSTRACT

A base bracket comprises a heel and hook member, a heel reinforcement, a bottom swing tab, and a backload pin. When the bracket is properly positioned in a slot in a shelf upright, the pin is adapted to pass through aligned holes in the shelf upright, the hook, and the bottom swing tab.

1 Claim, 6 Drawing Figures

BASE BRACKET FOR SHELVING

BACKGROUND OF THE INVENTION

A base bracket assembly for shelving is required to securely engage a shelf upright at one end of the bracket assembly, the other end of the bracket assembly resting on the floor. The end of the bracket assembly engaging the shelf upright must have sufficient strength to resist bending due to loads on upper shelves both to the front and to the rear of the shelf upright.

The base bracket assembly is generally secured to the shelf upright with the upright lying on the floor. The upright is then raised to a vertical position and placed, with the base bracket assembly firmly secured thereto, in its desired position on the floor.

It is an object of this invention to provide a base bracket having excellent strength when the upright it is secured to is subjected to both front loading and back loading.

It is a further object to provide a base bracket that is firmly secured to the upright whereby the bracket does not disengage from the upright during movement of the bracket-upright combination from one point to another on the floor.

SUMMARY OF THE INVENTION

The invention resides in the combination of an upright with a novel bracket. The upright has a vertical slot therein and mutually aligned holes passing therethrough whereby the mutual axis of said holes is perpendicular to said slot. The bracket has a main body comprising a hook and heel member. The hook is characterized by a notch one wall of which is adapted to engage a first surface of the upright after the hook is passed through the vertical slot. The hook is also provided with a hole that is aligned with the holes in the upright when the hook is properly positioned with respect to the upright.

A tab is rotatably secured to the heel member. The tab is provided with a notch one wall of which is adapted to engage a second surface of the upright after the tab is passed through the vertical slot. The tab is also provided with a hole that is aligned with the holes in the upright when the notch in the tab engages the upright.

A pin is passed through the holes in the upright, the hook, and the tab to secure the bracket in place on the upright.

DESCRIPTION OF THE PREFERRED EMBODIMENT

Figures 1, 2, 3, 4, 5, 6:
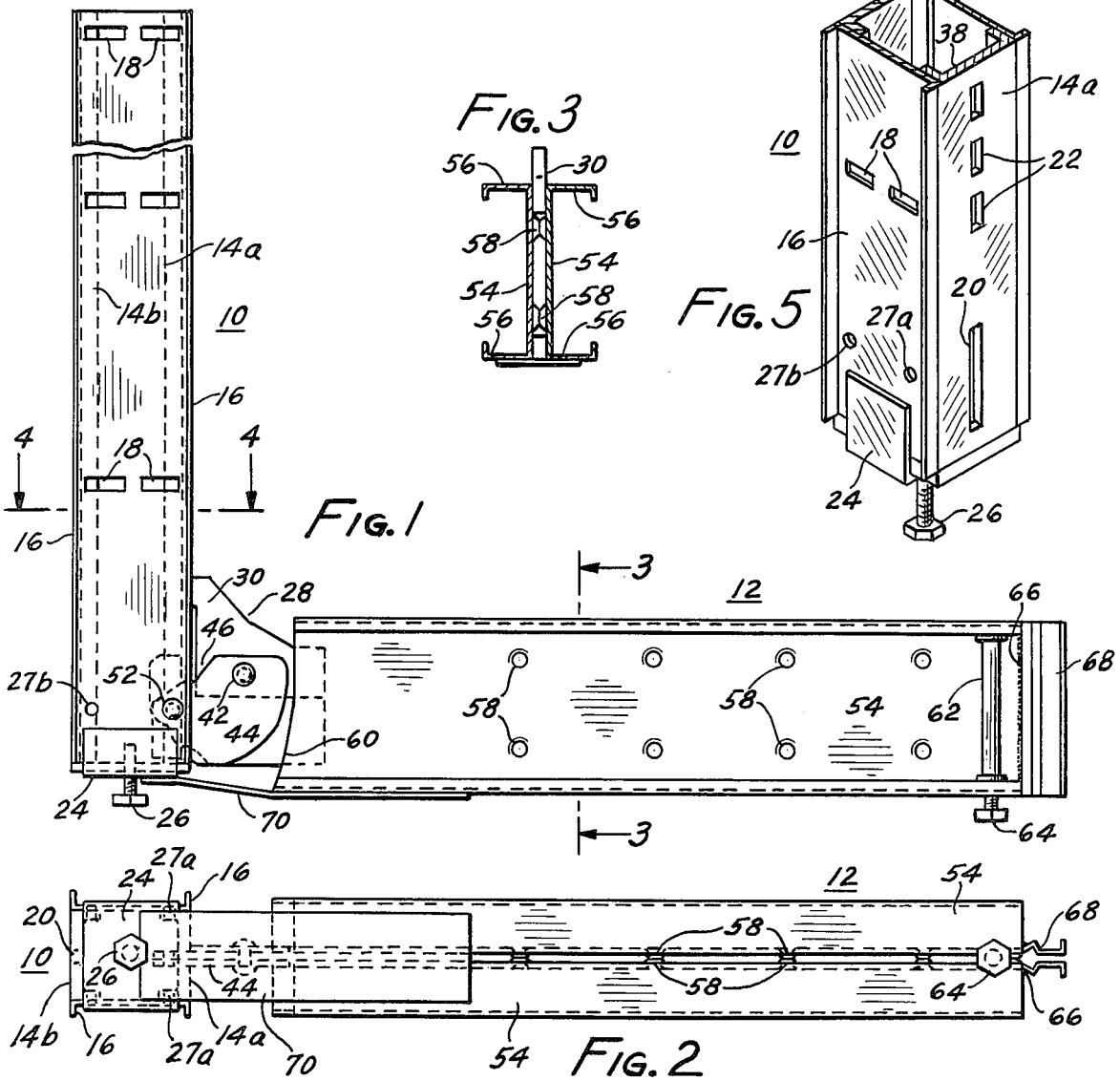
FIG. 1 is a side elevation view of an upright having a base bracket assembly secured thereto.
FIG. 2 is a bottom plan view of the upright and bracket assembly shown in FIG. 1.
FIG. 3 is a sectional view along the lines 3—3 of FIG. 2.
FIG. 4 is a sectional view along the lines 4—4 of FIG. 1.
FIG. 5 is an isometric view of a portion of an upright.
FIG. 6 is a side elevation of the base bracket assembly before it is rigidly secured to the upright.

As shown in FIG. 1, an upright 10 has a base bracket assembly 12 secured thereto. The upright 10, as shown in FIGS. 4 and 5, comprises two facing channel members 14*a* and 14*b* having opposed sheet metal sides 16 welded thereto. The sides 16 are provided with slots 18 to receive spacing rails (not shown). The channel members 14*a* and 14*b* are each provided with a slot 20, which receives the base bracket assembly 12, and a plurality of slots 22, a number of which receive upper shelf brackets (not shown). The lower end of the upright 10 has a sheet metal nut 24 welded thereto, nut 24 being adapted to receive a leveling screw 26. The upright 10 is provided with two pairs of mutually aligned holes 27*a* and 26*b*, respectively.

Reference is here made to FIG. 6, which shows the base bracket assembly 12 before it is rigidly secured to the upright 10. The bracket itself, herein designated by the numeral 28, comprises an integral heel member 30 and a hook member 32. The hook 32 is characterized by a notch 34 one wall 36 of which is adapted to engage a first surface of one wall 38 of channel member 14*a* after the hook 32 passes through the slot 20. The hook 32 is further provided with a hole 40 that is aligned with the holes 27*a* when the hook 32 is properly positioned with respect to the upright 10.

Rotatably secured to the heel member 30, by a rivet 42, for example, is a tab 44. The tab 44 is characterized by a notch 46 one wall 48 of which is adapted to engage a second surface of wall 38 of channel member 14*a* after the tab 44 passes through the slot 20. The tab 44 is further provided with a hole 50 that is aligned with the holes 27*a* when wall 48 of the notch 46 engages the upright 10.

As shown in FIG. 1, a pin 52 passes through the holes 27*a* in the upright 10, the hole 40 in the hook member 32, and the hole 50 in the tab 44, thereby securing the bracket 28 in place on the upright 10.

As shown in FIGS. 1, 2 and 3, the base bracket assembly 12 further comprises a pair of longitudinal sheet metal members 54 each provided with flanges 56. The members 54 are spaced apart from each other in order to provide space to insert heel member 30 therebetween and weld it to members 54. This spacing is achieved by forming a plurality of opposed nipples 58 in members 54 and then spot welding these members together at these nipples.

Members 54 are provided with a cam surface 60 at one end thereof. Surface 60 serves as a stop for tab 44. Members 54 are also provided with a vertical drawn section 62 to which is welded a threaded sleeve (not shown). The sleeve threadedly engages a leveling screw 64.

Screwed to the far end of the bracket assembly 12, by weld 66, for example, is a clip 68 for securing a base panel (not shown) thereto. A reinforcing strap 70 may be welded between the bottom of the upright 10 and the bottom of the base bracket assembly 12 if the shelf structure is to be permanently located.

To secure the base bracket assembly 12 to the upright 10, the upright 10 is first placed flat. The hook member 32 is then passed through the slot 20, and the heel member 30 is pivoted until it makes contact with channel member 14*a*. Tab 44 is then rotated until notch wall 48 makes contact with the inside of channel member 14*a*. Pin 52 is then passed through the aligned holes 27*a*, 40 and 50 to complete the operation. This operating sequence is merely reversed to disengage the base bracket assembly 12 from the upright 10.

I claim:

1. In combination with an upright, said upright having a vertical slot therein and mutually aligned holes passing through said upright whereby the mutual axis of said holes is perpendicular to said slot, a bracket comprising:

(a) a main body comprising a hook and heel member, said hook being characterized by a notch one wall of which is adapted to engage a first portion of a surface of said upright after said hook passes through said vertical slot, said hook being provided with a hole that is aligned with the holes in said upright when said hook is properly positioned with respect to said upright, (b) a tab rotatably secured to said heel member, said tab being characterized by a notch one wall of which is adapted to engage a second portion of said surface of said upright after said tab passes through said vertical slot, said tab being provided with a hole that is aligned with the holes in said upright and the hole in said hook when the notch in said tab engages said upright, and (c) a pin adapted to pass through the holes in said upright, said hook, and said tab whereby said bracket is secured to said upright.

* * * * *